United States Patent [19]

Bailey

[11] 4,172,711

[45] Oct. 30, 1979

[54] LIQUEFACTION OF GAS

[75] Inventor: Dunn M. Bailey, Bartlesville, Okla.

[73] Assignee: Phillips Petroleum Company, Bartlesville, Okla.

[21] Appl. No.: 905,504

[22] Filed: May 12, 1978

[51] Int. Cl.[2] ..... F25J 3/06

[52] U.S. Cl. ..... 62/21; 62/37; 62/23; 62/40

[58] Field of Search ..... 62/9, 11, 23, 21, 37

[56] References Cited

U.S. PATENT DOCUMENTS

| | | | |
|---|---|---|---|
| 2,960,837 | 11/1960 | Swenson et al. | 62/40 |
| 3,020,723 | 2/1962 | De Lury et al. | 62/40 |
| 3,254,495 | 6/1966 | Jackson et al. | 62/40 |
| 3,290,890 | 12/1966 | Bray et al. | 62/23 |
| 3,292,382 | 12/1966 | Bray et al. | 62/23 |
| 3,413,817 | 12/1968 | Kniel | 62/26 |
| 3,874,184 | 4/1975 | Harper et al. | 62/23 |

*Primary Examiner*—Norman Yudkoff

[57] ABSTRACT

A process for liquefying a natural gas, having a pressure above atmospheric pressure, in which a feed gas is cooled to sequentially lower temperatures, by passing the gas through a plurality of cooling stages, in indirect heat exchange with at least one refrigerant, until the gas is substantially completely condensed in the last of the cooling stages, a fuel gas fraction is withdrawn from the liquefied gas in an amount proportional to the amount of feed gas passing through the cooling stages and, thereafter, the pressure of the remaining liquefied gas is reduced to essentially atmospheric pressure. Apparatus for carrying out the process is also described.

47 Claims, 2 Drawing Figures

LIQUEFACTION OF GAS

BACKGROUND OF THE INVENTION

The present invention relates to the liquefaction of a gas. More particularly, the present invention relates to a method and apparatus for the liquefaction of a lean natural gas having a pressure above atmospheric pressure.

Numerous reasons exist for the liquefaction of gases and particularly of natural gas. The primary reason for the liquefaction of natural gas is that the liquefaction reduces the volume of a gas by a factor of about 1/600, thereby making it possible to store and transport the liquefied gas in containers of more economical and practical design.

For example, when gas is transported by pipeline from the source of supply to a distant market, it is desirable to operate under a substantially constant high load factor. Often the capacity will exceed demand while at other times the demand may exceed the capacity of the line. In order to shave off the peaks where demand would exceed supply, it is desirable to store the gas when the supply exceeds demand, whereby peaks in demand can be met from material in storage. For this purpose it is desirable to provide for the storage of gas in a liquefied state and to vaporize the liquid as demand requires.

Liquefaction of natural gas is of even greater importance in making possible the transport of gas from a source of plentiful supply to a distant market, particularly when the source of supply cannot be directly joined with the market by pipeline. This is particularly true where transport must be made by ocean going craft. Ship transportation in the gaseous state would be uneconomical unless the gaseous materials were highly compressed, and then the system would not be economical because it would be impractical to provide containers of suitable strength and capacity.

In order to store and transport natural gas, the reduction of the natural gas to a liquefied state requires cooling to a temperature of about −240° F. to −260° F. at atmospheric pressure.

Numerous systems exist in the prior art for the liquefaction of natural gas or the like in which the gas is liquefied by passing it sequentially through a plurality of cooling stages, to cool the gas to successively lower temperatures until the liquefaction temperature is reached. In this instance, cooling is generally accomplished by indirect heat exchange with one or more expanded refrigerants such as propane, propylene, ethane, ethylene, and methane. Once the gas has been liquefied at the feed gas pressure, the gas is expanded to atmospheric pressure by passing the liquefied gas sequentially through a plurality of expansion stages. During the course of the expansion, the gas is further cooled to storage or transport temperature and its pressure reduced to atmospheric pressure, and significant volumes of the gas are flashed. The flashed vapors from the expansion stages are generally collected, compressed to the pressure of the feed gas and then combined with the feed gas.

The natural gas feed to such systems generally contains small amounts of nitrogen which is desirably removed from the liquefied gas prior to storage or transport. Accordingly, it is common practice to remove the nitrogen by passing the liquefied gas through a nitrogen removal column or the like to vaporize the nitrogen and a portion of the methane. The nitrogen-containing gas thus removed will usually contain sufficient methane to make it useful as a fuel. Consequently, such nitrogen-gas is used as a fuel to operate liquefaction plant equipment, such as compressors, etc. Conventionally, the amount fuel gas removed is controlled indirectly by determining the composition or BTU value of the fuel gas and maintaining a predetermined composition. This technique, thus, fails to consider the fuel needs of the plant. Accordingly, if the feed gas flow to the plant drops below normal and, therefore, less fuel is needed to operate the plant, the amount of fuel withdrawn will often be greater than needed and the excess must be disposed of, usually by flaring. Conversely, should the feed gas flow increase and the fuel demands increase, insufficient fuel gas will often be withdrawn and the deficit must be made up from other sources, such as by using part of the high quality gas being processed. Obviously, such practices are uneconomical and wasteful.

SUMMARY OF THE INVENTION

It is, therefore, an object of the present invention to overcome these and other disadvantages of the prior art. Another object of the present invention is to provide an improved process and apparatus for the liquefaction of natural gas. A further object of the present invention is to provide an improved process and apparatus for the liquefaction of natural gas wherein fuel gas is withdrawn from the process stream in an effective and efficient manner. Another and further object of the present invention is to provide an improved method and apparatus for the liquefaction of natural gas wherein fuel gas is withdrawn from the process stream in amounts correlated with the needs of the process. Yet another object of the present invention is to provide a process and apparatus for the liquefaction of natural gas wherein fuel gas is withdrawn from the process stream in amounts correlated with the amounts of feed gas being processed.

These and other objects and advantages of the invention will be apparent to one skilled in the art from the following description.

The present invention relates to a process for the liquefaction of natural gas.

More specifically, in accordance with the present invention, a process and apparatus is provided in which a natural gas, having a pressure above atmospheric pressure, is liquefied by cooling the feed gas to successively lower temperatures, by passing the gas in indirect heat exchange with at least one refrigerant, until the feed gas is liquefied, withdrawing a vapor-phase fuel gas from the liquefied gas in an amount proportional to the amount of feed gas being processed and, thereafter reducing the pressure of the remaining liquefied gas to essentially atmospheric pressure.

DESCRIPTION OF THE PREFERRED EMBODIMENT

Figure 1:
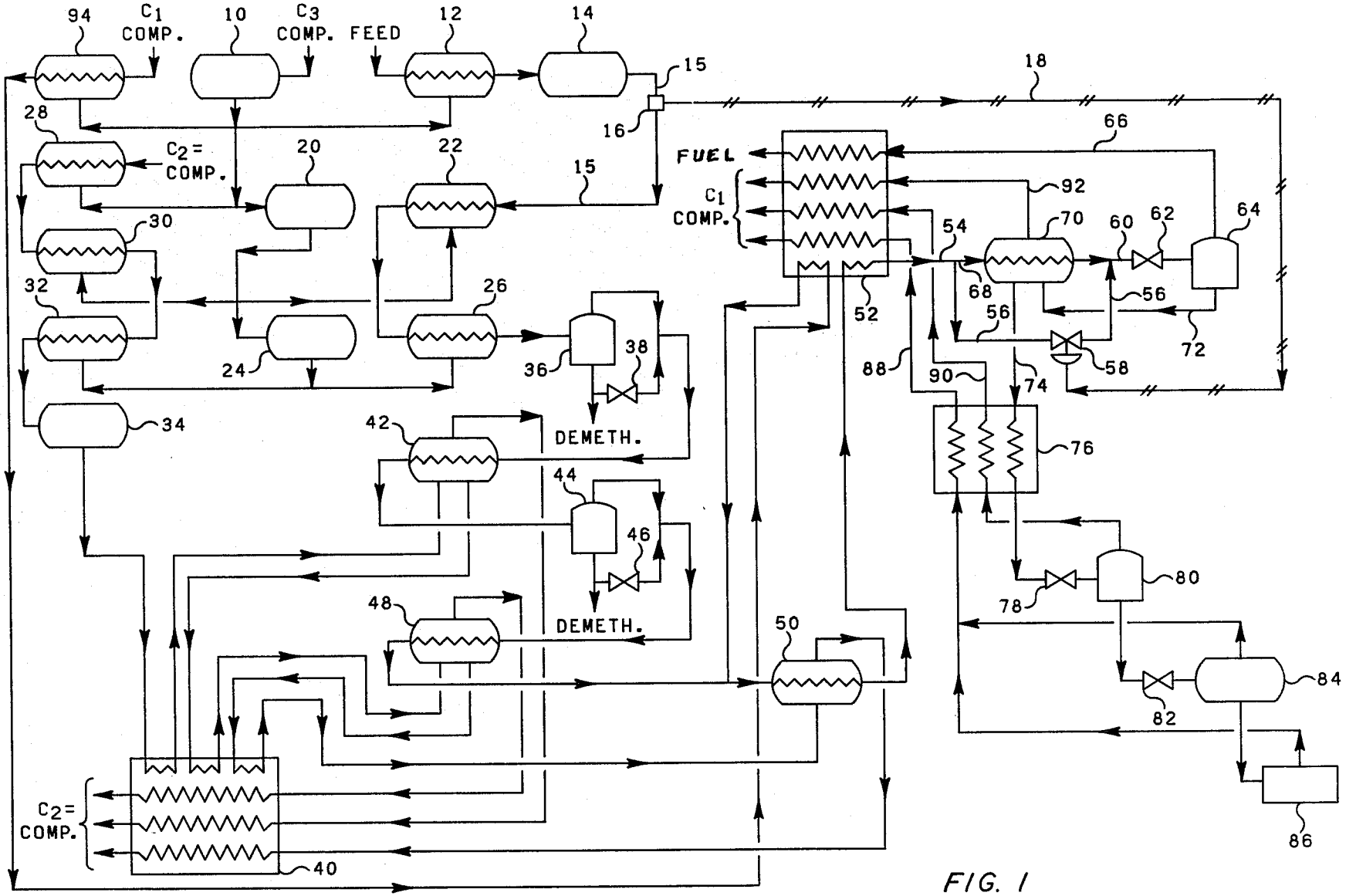
FIG. 1 of the drawings is a simplified flow diagram illustrating an overall process for the practice of the present invention.

According to a preferred embodiment of the present invention, fuel gas, for the operation of the equipment of a natural gas liquefaction plant, is withdrawn from the process stream of the plant in accordance with the energy demands of the plant. More specifically, the amount of fuel gas withdrawn from the process stream of a natural gas liquefaction plant, for the operation of plant equipment, is correlated with and preferably, controlled by the amount of natural gas being processed by the plant at any given time.

In the operation of a natural gas liquefaction plant the volume of natural gas feed to the plant will ordinarily vary over a relatively wide range. As the volume of natural gas being processed by the plant drops below a median level, the fuel demands of the processing plant equipment, such as compressors, etc., will also drop. Conversely, when the volume of natural gas being processed exceeds the median level, the fuel demands of the processing plant will also increase. Therefore, it is highly desirable, in the operation of a natural gas liquefaction plant in which fuel for the operation of the plant is withdrawn from the process stream, to be able to correlate and control such withdrawal in accordance with the demands of the plant.

The natural gas feed to the plant may be any conventional natural gas stream, such as a lean gas stream containing predominantly methane with small amounts of heavier hydrocarbons and, usually, nitrogen, or a rich gas stream containing significant amounts of hydrocarbons heavier than methane and, usually, small amounts of nitrogen.

To the extent that the pressure of the gas is below about 600 psia, the gas is preferably compressed to a pressure in this neighborhood, since the preferred process of this invention operates most efficiently at this pressure. In some cases the gas may be at a higher pressure, such as 800 psia or more. In this case the gas is most efficiently and effectively processed by first cooling the gas to near its liquefaction temperature at the existing pressure and then reducing the pressure to about 600 psia just prior to its condensation.

The feed gas is cooled to its liquefaction temperature by passing the same through a plurality of cooling stages maintained at successively lower temperatures. Any suitable refrigerant or combination of refrigerants may be employed. For example, because of their availability and cost, preferred refrigerants are propane, propylene, ethane, ethylene and other normally gaseous materials or mixtures thereof which have been compressed to liquefy the same. To the extent that more than one refrigerant is utilized in the cooling train, the refrigerant utilized in a later portion of the cooling train will have a boiling point lower than the refrigerant utilized in the earlier stages of the cooling train. In the preferred embodiment propane is utilized in a first cycle of the cooling train and ethylene is utilized in a second cycle of the cooling train.

Any number of cooling stages may be employed when using single or plural cooling cycles, depending upon the composition, temperature and pressure of the feed gas. When the feed gas is a lean natural gas at a pressure in the neighborhood of 600 psia and 90° F. and at essentially atmospheric temperature, it is preferred that three stages of cooling, using propane, as a refrigerant, be followed by three stages of cooling, using ethylene as a refrigerant.

Preferably, when two or more refrigerants are employed in successive cooling cycles, the first refrigerant is compressed to liquefy the same while each of the downstream refrigerants is cascaded with the next previous refrigerant, that is, the downstream refrigerant is cooled to its liquefaction temperature by heat exchange with a portion or portions of the next previous refrigerant. In the preferred process being described, the propane is liquefied by compression and compressed ethylene is cooled to its liquefaction temperature by indirect heat exchange with a plurality of portions, preferably three, of propane flashed to successively lower pressures and hence temperatures.

At any time following the first stage of cooling, water or hydrocarbons heavier than methane may be removed from the gas being processed as necessary or desired. While the feed gas is normally treated for the removal of water prior to cooling the same for purposes of liquefaction, residual amounts of moisture will normally condense out during the early stages of cooling. Therefore, the gas is passed through a dehydrator at an appropriate point in the cooling train. In the exemplified case this is done following the first stage of cooling. The necessity and/or desirability of removing heavy hydrocarbons as well as the point or points of removal will depend upon the composition of the gas being processed and the desired composition of the liquefied gas product. In the preferred embodiment, heavy hydrocarbons are removed following both the third stage of propane cooling and the first stage of ethylene cooling. The condensed heavy hydrocarbons are then set to an appropriate demethanizer column for separation of methane entrained in the condensed heavy hydrocarbons. The methane can then be recycled to the feed gas at an appropriate point and the heavy hydrocarbons can be recovered as a natural gas liquids product. In the present example, further control of the composition of the liquefied gas product is attained by separating and returning to the feed gas stream, all or any part of the separated liquids. As indicated previously, the heavy hydrocarbon separation can be eliminated or a fewer or larger number of separations carried out. Also, depending on the composition of the condensed heavy hydrocarbons, a demethanizer, a deethanizer and/or natural gas liquids separators may be appropriately used to further separate the removed liquids.

Cooling is effected in the cooling stages of this embodiment by flashing the liquefied refrigerant directly into the feed gas cooler or flashing the refrigerant in separate flash drums and then passing the flashed fluids to the feed gas cooler. In the present example, the propane is flashed in separate flash drums and then passed to the feed coolers and the ethylene is flashed directly into the feed coolers. Where more than one stage is employed for a particular refrigerant each successive stage of refrigerant is flashed to a lower pressure and, hence, a lower temperature. In a multiple stage refrigerant cycle, parallel streams of the refrigerant may be passed to the different stages or the refrigerant may be passed through the stages in series, the unflashed liquid from each stage being passed to the next succeeding stage.

In the preferred operation being described propane gas flashed from the liquefied propane during cooling of the feed is passed to the propane compressor or compressors for reuse in the process. However, the cold remaining in the gas may be utilized for other in-plant cooling. This technique is employed in the preferred ethylene cycle. Specifically, the cold remaining in the ethylene gas flashed from the liquid ethylene during feed cooling is extracted by passing the same in countercurrent, indirect heat exchange with the liquid ethylene passing to each stage of cooling. In this manner, the liquid ethylene is also precooled.

Following condensation of the feed gas stream, a vapor phase fuel gas, containing substantially all of the nitrogen in the feed gas, is separated from the liquefied feed gas, in a manner to be detailed hereinafter.

The remaining liquefied gas, still at essentially the feed gas pressure, is then reduced in pressure to essentially atmospheric pressure and passed to storage or transport. In the present embodiment, this is accomplished by flashing the liquefied gas to the desired lower pressure in a plurality of stages, preferably three. Specifically, the liquefied gas is expanded into a high stage flash drum, the unflashed liquid from the high stage flash is flashed into an intermediate stage flash drum, the unflashed liquid from the intermediate stage flash is flashed into a low stage flash drum and the unflashed liquid from the low stage flash, at essentially atmospheric pressure, is passed to storage or transport. Flashed gases from the storage vessel, the low stage flash and the intermediate stage flash have residual cold extracted therefrom by countercurrent, indirect heat exchange first with the liquid feed to the intermediate flash and then with the liquefied feed to the pressure reduction cycle. Flashed gas from the high stage flash is also used to cool liquefied feed to the pressure reduction cycle.

The flashed gases from the three pressure reduction stages are then passed to a methane compressor or compressors, the compressed methane is then precooled by heat exchange with a portion of the propane refrigerant, further cooled by countercurrent heat exchange with the flashed gases from the pressure reduction cycle and recycled to the feed gas stream at an appropriate point, where the temperature and pressure of the recycled gas is essentially the same as the feed gas. In the preferred case, the recycle gas is introduced just prior to the passage of the feed gas to the feed gas condenser.

As previously indicated, the fuel gas, to be employed as plant fuel, is separated from the liquefied feed gas stream after condensation thereof but before the expansion cycle. This may be accomplished by passage of the liquefied feed gas through a nitrogen removal column or by flashing the liquefied feed gas into a fuel flash drum. In any event, the volume of fuel gas separated is adjusted to correspond to the fuel demands of the plant by measuring the volume of feed gas to the plant at an appropriate point, as by a flow indicator means, and utilizing the measured feed gas volume to control a property of the liquefied gas feed to the fuel gas separation means. Preferably, the property of the liquefied feed gas to the fuel gas separation means which is controlled is the temperature thereof. By thus adjusting the temperature of this stream is proportion to the volume of feed gas to the process, the volume of fuel gas separated in the separator means will be adjusted and will be just sufficient to supply the fuel demands of the plant. If the volume of feed gas to the plant decreases, the temperature of the liquefied gas to the fuel separator will be reduced thus reducing the volume of fuel gas separated. If the volume of feed gas increases, the temperature of the liquefied feed to the fuel separator is increased thus increasing the volume of fuel gas separated to adjust the volume to the increased fuel demands of the plant.

In the preferred embodiment of the invention, the fuel gas separator is a fuel flash drum into which the liquefied gas is flashed to a lower pressure. This use of a fuel flash drum also permits the utilization of a novel means of adjusting the temperature of the liquefied gas feed to the fuel flash drum. Specifically, all of any part of the liquefied gas feed to the fuel flash drum is passed in indirect heat exchange through the flash drum of the first pressure reduction stage (high stage flash) of the pressure reduction cycle and any remaining portion of the liquefied gas feed to the fuel flash drum is bypassed around the high stage flash. By placing a control valve in the line to the high stage flash heat exchange or in the bypass line therearound and controlling such valve in accordance with the volume of feed gas to the process, the temperature of the liquefied gas feed to the fuel flash drum and, hence, the volume of fuel flashed, may be adjusted in accordance with variations in the volume of feed gas to the plant.

In a specific embodiment, the volume of feed gas to the system is measured by a flow indicator and transmitted to the controlled station by a flow transmitter. The transmitter feed gas flow signal is then used as a set point to adjust the valve in the line to the fuel flash drum. More specifically, the fuel gas flow from the fuel flash drum is measured and a signal proportional thereto is transmitted to a flow recorder controller. The set point for the flow recorder control is obtained by producing a signal representative of the volume of fuel needed to operate plant equipment for the particular feed gas flow and utilizing this signal to set the flow recorder controller. The signal representative of the fuel needed is produced, in the exemplified case, by a bias relay means operating on the feed gas flow signal. The flow recorder controller then sends an appropriate control signal to the control valve to adjust the flow through the high stage flash heat exchanger. The feed gas flow signal is also transmitted to a flow recorder controller which is set externally for a predetermined flow. The flow control signal from this flow recorder controller is sent to a control valve mounted in the flow line to the fuel flash drum beyond the bypass around the high pressure flash. The pressure in this line to the fuel flash drum is also measured and a control signal representative of a minimum pressure, necessary to achieve liquefaction, is produced by a pressure indicator controller. The control signal from the pressure indicator controller and the control signal from the flow recorder controller are compared, as by means of a selector relay, and the signal from the flow recorder controller is either passed or not passed to the control valve. If the flow dictated by the flow recorder controller is greater than the flow which can be accommodated by the measured feed gas flow and opening the control valve further would depressurize the system, the control signal from the pressure indicator controller will override the signal from the flow recorder controller and prevent the latter from opening the valve further.

The preferred embodiment of the present invention will be understood more fully by reference to the drawings.

Referring to FIG. 1 of the drawings, liquefied propane from a propane compressor or compressors is supplied to propane refrigerant accumulator 10. Feed gas to be liquefied is passed through feed-high stage propane evaporator 12 in indirect heat exchange with propane flashed into the evaporator 12 from accumulator 10. The feed gas thereafter passes to dehydrator 14 where residual amounts of water are removed at the lowered temperature. As the dehydrated feed gas passes from dehydrator 14 through line 15 its flow rate is measured by flow indicator-transmitter 16. A signal representative of the feed gas flow rate is transmitted through line 18 for purposes hereinafter described. A second portion of the liquid propane refrigerant from accumulator 10 is passed to high stage propane flash drum 20. In flash drum 20 the propane is flashed to a lower pressure and hence a lower temperature. A portion of the unflashed liquid propane from flash drum 20 is flashed to a still lower pressure and temperature in feed-interstage propane evaporator 22 where it further cools the feed gas from dehydrator 14. A second portion of the uncondensed liquid propane from flash drum 20 is passed to interstage propane surge-flash tank 24. In surge-flash tank 24 the liquid propane is flashed to a lower pressure and temperature essentially equivalent to the pressure and temperature existing in interstage propane evaporator 22. A portion of the unflashed liquid propane from surge-flash tank 24 is then flashed to a still lower pressure and temperature in feed-low stage propane evaporator 26, where it further cools the feed gas from interstage evaporator 22 by indirect heat exchange. This completes the propane cycle of the feed gas cooling. Flashed propane vapors from units 12, 20, 22, 24 and 26 are withdrawn through appropriate lines (not shown) and returned to the propane compressor. While three stages of propane cooling are shown in this specific embodiment, the actual number may differ based on the initial temperature of the feed gas. Likewise, dehydrator 14 may be eliminated and/or various other treaters or heavy hydrocarbon separators may be utilized depending upon the composition of the feed gas.

The second refrigerant cycle employs a refrigerant having a lower boiling point than the first refrigerant. While the present specific example utilizes ethylene as the second refrigerant, the refrigerant may be any other suitable refrigerant, such as ethane or a mixture of refrigerants.

Returning to the specific example, a third portion of liquid propane from accumulator 10 is flashed into ethylene-high stage propane evaporator 28, where it cools ethylene supplied from an appropriate ethylene compressor or compressors. The cooled ethylene is then passed through ethylene-interstage propane evaporator 30. A third portion of the unevaporated liquid portion from propane flash drum 20 is flashed into evaporator 30. The further cooled ethylene then passes in indirect heat exchange through ethylene condenser 32 where it is liquefied and then to ethylene surge tank 34 where it is ready for use as a feed gas refrigerant. In the meantime, the feed gas from the low stage propane evaporator is passed to heavy hydrocarbon separator 36. In separator 36, methane and heavier hydrocarbons, which have been condensed, are separated from the feed gas. All or part of the separated liquefied heavy hydrocarbons can be passed to a suitable demethanizer column (not shown) for further separation. Valve 38 may be operated to recycle part or all of the separated, liquefied heavy hydrocarbons back to the feed gas, depending upon the desired composition of the ultimate liquefied gas and upon the composition of the feed gas. The liquefied ethylene from surge tank 34 is passed through ethylene economizer heat exchanger 40, where it is further cooled and thence to high stage ethylene feed gas chiller 42. In chiller 42, ethylene is flashed to a lower pressure and hence a lower temperature and cools the feed gas from separator 36 by indirect heat exchange. The feed gas then passes to natural gas liquids separator 44, where heavy hydrocarbons condensed at the existing feed gas temperature are separated as a liquid. Obviously, the heavy hydrocarbons liquefied at this temperature will be those having a lower boiling point than the liquids separated in separator 36. All or part of the separated liquids are passed to the demethanizer (not shown) for further separation. In a manner similar to that employed in separator 36, valve 46 can be manipulated to recycle part or all of the condensed and separated liquids from separator 44 back to the feed gas. Unvaporized ethylene liquid from chiller 42 is passed through ethylene economizer 40 and is then flashed to a lower pressure and temperature in interstage ethylene feed gas chiller 48. Feed gas from separator 44 is passed in indirect heat exchange with the ethylene fluids in chiller 48. Unflashed liquid ethylene from chiller 48 passses through ethylene economizer 40 and is then flashed to a lower pressure and temperature in feed condenser 50. The feed gas from chiller 48 passes in indirect heat exchange with ethylene fluids in condenser 50 where its liquefaction is essentially complete and it is at a pressure slightly lower than the original pressure. Flashed ethylene vapors from chillers 42 and 48 and condenser 50 are passed through ethylene economizer 40 where the residual cold is extracted therefrom in cooling the liquid ethylene refrigerant prior to its passage to chillers 42 and 48 and condenser 50, respectively. The ethylene vapors are then returned to ethylene compression and further use. The ethylene cycle is thus complete. As in the propane cycle the number of stages will depend upon the original feed gas temperature and the cooling effected to the propane cycle, and the desirability or necessity of separating heavy hydrocarbons will depend upon the feed gas composition and the desired composition of the final liquefied natural gas.

The liquefied feed gas then passes serially through a plurality of flash stages where its pressure is reduced to essentially atmospheric pressure for storage or transport and its temperature is further reduced. Normally, the liquefied feed gas would be passed from condenser 50 to a nitrogen removal column or a fuel flash drum, depending on $N_2$ content of feed gas, where an overhead vapor fraction, containing substantially all of the nitrogen, would be recovered and utilized as a plant fuel for operating the LNG plant compressors and the like. It is also conventional in such prior art techniques to determine the compositon of the fuel gas and adjust its composition by adjusting the volume of vapors recovered as the nitrogen product. However, in the present invention this same general function is performed by a fuel flash stage operated in a novel manner.

Referring again to FIG. 1, the liquefied feed gas from condenser 50 is passed through methane economizer 52, where it is further cooled, as explained hereinafter and thence through line 54. Normally, the LNG then passes through line 56, valve 58 therein and, thence, line 60 and valve 62 therein to fuel flash drum 64. As will be explained in greater detail with reference to FIG. 2, valve 58 is controlled by the signal passing through line 18. Vapors flashed from the LNG in flash drum 64 are passed through line 66 to economizer 52, where they are utilized to cool the LNG, and then are utilized as plant fuel. Alternatively, the LNG from line 54 is passed through line 68 and in indirect heat exchange with fluids in high stage methane flash-fuel economizer 70. Unflashed LNG from fuel flash drum 64 is passed through line 72 to high stage methane flash-fuel economizer 70 where it is flashed to a lower pressure and its temperature reduced. Unflashed LNG from unit 70 is discharged through line 74 and passed through interstage methane economizer 76 and thence through flash valve 78 to interstage methane flash drum 80, where its pressure is further reduced and its temperature lowered. Unflashed LNG from interstage flash 80 passes through flash valve 82 to final flash drum 84, where its pressure is reduced to essentially atmospheric pressure and its temperature further reduced to storage and/or transport temperature. Unflashed LNG from final flash 84 is passed to storage unit 86. Vapors which accumulate in storage unit 86 are combined with flashed vapors from final flash 84 and passed through economizer 76, where they are warmed in cooling the LNG. From economizer 76 these vapors pass through line 88, through economizer 52 and thence to a methane compressor or compressors (not shown). Flashed vapors from interstage flash 80 pass through economizer 76, line 90, economizer 52 and thence to the methane compressor. Flashed vapors from high stage flash 70 pass through line 92, economizer 52 and thence to the methane compressor. Compressed methane vapors from the compressor (at essentially the same pressure as the feed gas) are passed in indirect heat exchange through methane precooler 94. Cooling in precooler 94 is obtained by flashing a fourth portion of propane from accumulator 10 into the precooler 94. The cooled methane from precooler 94 then passes through economizer 52, where it is cooled to approximately the temperature of the feed gas passing to condenser 50, and it is then combined with the feed gas to condenser 50.

As indicated previously, the volume of the fuel gas required to operate plant equipment is a function of the volume of feed gas entering the plant. In order to thus control the volume of fuel gas a property, preferably the temperature, of the LNG to the fuel flash drum is controlled. This control is generically accomplished by reading the feed gas flow, using this flow to set a flow recorder controller which is receiving a signal indicative of the fuel gas volume and adjusting valve 58 in line 56 to bypass more or less LNG around the high stage methane flash-fuel economizer 70. Valve 58 is opened to increase the temperature of the LNG to fuel flash 64, thus flashing more fuel gas, and is closed to decrease the temperature of the LNG to fuel flash 64, thus flashing less fuel gas.

Figure 2:
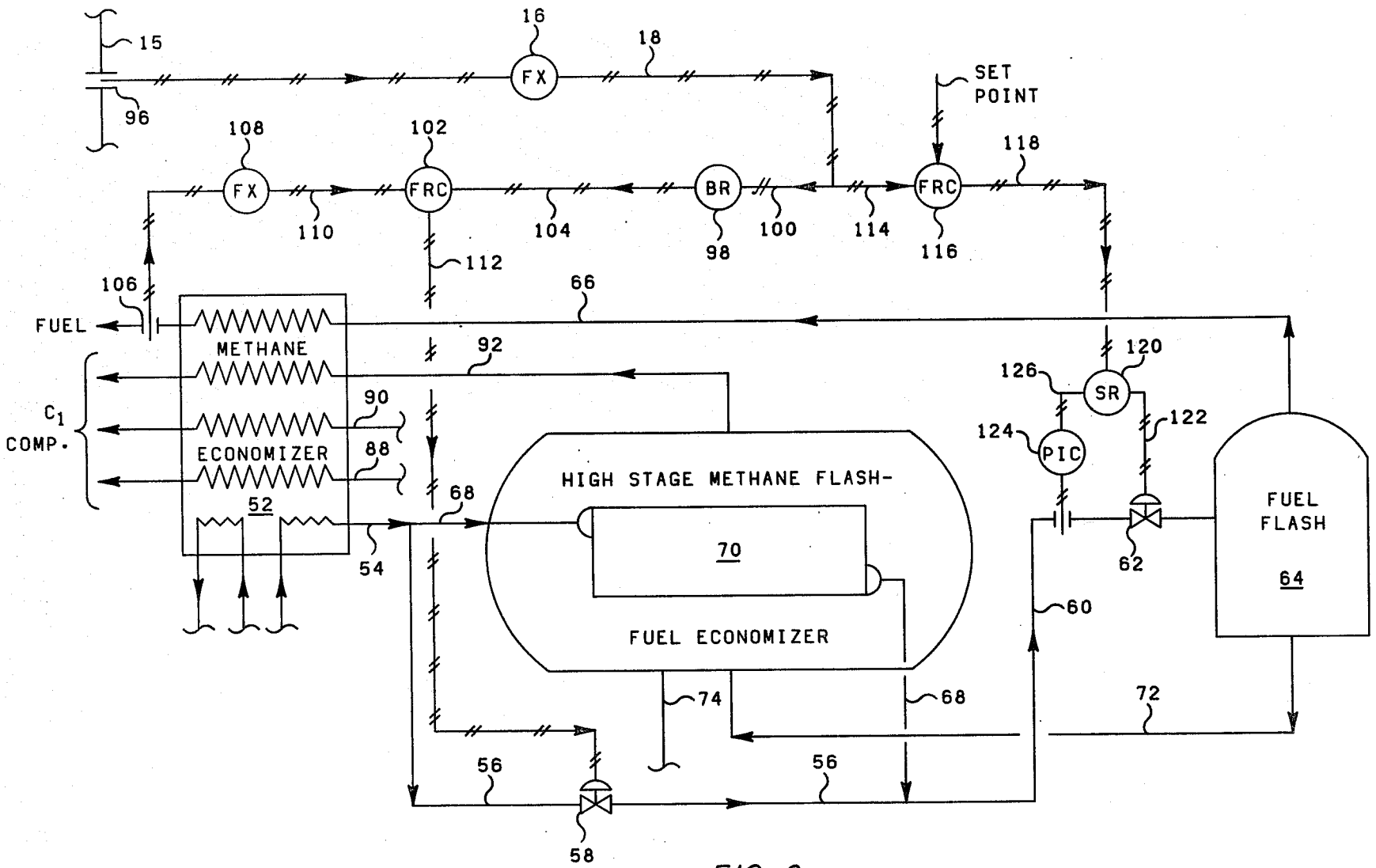
FIG. 2 is a more detailed flow diagram of that portion of the process illustrated in FIG. 1 which illustrates a specific means for withdrawing fuel gas and controlling such withdrawal.

Referring to FIG. 2, the feed gas flow to the plant is measured by flow indicator 96 and a signal representative of the measured flow is transmitted through line 18 by flow transmitter 16. The flow signal from line 18 is transmitted to bias relay means 98, through line 100, where it is converted to a signal indicating the volume of fuel gas needed to operate the plant equipment for the volume of feed gas flow measured. This signal is transmitted to flow recorder controller 102 as a set point signal, through line 104. At the same time, the volume of fuel gas passing from the system is measured by flow indicator 106 and transmitted by flow transmitter 108 to flow recorder controller 102 through line 110. The control signal from flow recorder controller 102 is transmitted through line 112 to valve 58 to control said valve as indicated previously. The feed gas flow rate signal from line 18 is also transmitted through line 114 to flow recorder controller 116. A set point signal, representing a predetermined flow of LNG to fuel flash 64, is also fed to flow recorder controller 116. The control signal from flow recorder controller 116 is transmitted, through line 118, to selector relay 120 and thence to valve 62 through line 122 to adjust said valve. At the same time, the pressure in feed line 60 to fuel flash 64 is measured and transmitted to pressure indicator controller 124 which is set for a minimum pressure. A control signal from controller 124 is transmitted through line 126 to selector relay 120. If the flow set in flow recorder controller 116 is greater than can be supplied by the feed gas flow at the time and opening 62 further in response to the flow rate set in flow recorder controller 116 would depressurize the system, the control signal from pressure indicator controller 124 will override the control signal from flow indicator controller 116 and the valve will not be opened, as demanded by flow recorder controller 116.

The operation of the process on a typical lean gas feed, having a temperature of 100° F. and a pressure of 655 psia, will be exemplified for a feed gas flow rate of 37,286 mols/hour. After passage of the gas through the propane cycle and the first heavy hydrocarbon separator the flow rate to the ethylene cycle would be 36,291 mols/hour, the temperature −26° F. and the pressure 625 psia. The liquefied gas from the feed condenser would have a flow rate of 64,959 mols/hour, at a temperature of −132° F. and a pressure of 610 psia. The liquefied gas feed to the fuel flash drum would normally be at a rate of 64,959 mols/hour, at a temperature of −154° F. and a pressure of 602 psia. The liquefied gas from the fuel flash drum to the first flash of the pressure reduction cycle (high stage flash) would be at a flow rate of 50,893 mols/hour, at a temperature of −187° F. and a pressure of 179 psia. Finally, the pressure would be reduced to about 14.7 psia at a temperature between about −250° and −260° F. for storage or transport.

While specific materials, equipment and operations have been described herein and illustrated by the drawings, it is to be understood that these are not to be considered limiting and that variations, modifications and substitutions will be apparent to one skilled in the art without departing from the invention.

What is claimed is:

1. A process for reducing the pressure and vaporizing at least a portion of a pressurized liquid stream at least a portion of which is gaseous at a lower pressure, comprising:

passing said pressurized liquid stream through a first pressure reduction zone to reduce the pressure thereof to a first reduced pressure, produce a vapor phase component and a liquid phase component and separate the same into said vapor phase component and said liquid phase component;

passing said liquid phase component through a second pressure reduction zone to reduce the pressure thereof to a second reduced pressure lower than said first reduced pressure;

passing a first portion of said pressurized liquid stream in indirect heat exchange with at least a portion of the fluid from said second pressure reduction step prior to said passage of said first portion to said first pressure reduction zone and passing the remainder of said pressurized liquid stream directly to said first pressure reduction zone; and at least periodically adjusting the relative volumes of said portion of said pressurized liquid stream passed directly to said first pressure reduction zone and said remainder of said pressurized liquid stream passed in indirect heat exchange with said fluid in said second pressure reduction zone.

2. A process in accordance with claim 1 wherein the pressure is reduced in the first pressure reduction zone by expanding the pressurized liquid stream through an expansion valve means and the vapor phase component is separated from the liquid phase component by passing the reduced pressure liquid stream into a flash vessel.

3. A process in accordance with claim 2 wherein the pressure is reduced in the second pressure reduction zone by passing the liquid phase component into a second flash vessel and the portion of the pressurized liquid stream passed in heat exchange with the fluid from the second pressure reduction step is passed through said second flash vessel.

4. A process in accordance with claim 3 wherein the remainder of the pressurized liquid stream passed directly to the first pressure reduction zone is bypassed around the second flash vessel.

5. A process in accordance with claim 4 wherein a second vapor phase component and a second liquid phase component are produced by the second pressure reduction step and said second vapor phase component and said second liquid phase component are separated.

6. A process in accordance with claim 5 wherein the pressure of the second liquid phase component is reduced in at least one additional pressure reduction stage.

7. A process in accordance with claim 6 wherein the additional pressure reduction step comprises two pressure reduction stages.

8. A process in accordance with claim 7 wherein the additional pressure reduction stages include passing the second liquid phase component through a second expansion valve means, passing the expanded second liquid phase component to a second flash vessel to form a third vapor phase component and a third liquid phase component, separating said third vapor and liquid phase components, passing said third liquid phase component through a third expansion valve means, passing the expanded third liquid phase component to a fourth flash vessel to form a fourth vapor phase component and a fourth liquid phase component and separating said fourth vapor and liquid phase components.

9. A process in accordance with claim 6 wherein the pressure of the second liquid phase component is reduced to essentially atmospheric pressure in the additional pressure reduction step.

10. A process in accordance with claim 5, 6, 7, 8 or 9 wherein a pressurized normally gaseous feed stream is cooled to its liquefaction temperature by passing said normally gaseous feed stream through at least one cooling stage in indirect heat exchange with at least one refrigerant to produce the pressurized liquid stream and the separated second and any subsequent vapor phase components are recycled to and combined with the pressurized normally gaseous feed stream prior to the liquefaction thereof.

11. A process in accordance with claim 1, 2, 3, 4, 5, 6, 7, 8 or 9 wherein the relative volumes of the first portion of the pressurized liquid stream passed in indirect heat exchange with the fluid from the second pressure reduction step and the remainder of the pressurized liquid stream passed directly to the first pressure reduction step are adjusted in accordance with changes in the total volume of the pressurized liquid stream fed to the process.

12. A process in accordance with claim 11 wherein the relative volumes of the first portion of the pressurized liquid stream passed in indirect heat exchange with the fluid from the second pressure reduction step and the remainder of the pressurized liquid stream passed directly to the first pressure reduction step are adjusted to produce a volume of the first vapor phase component directly proportional to the total volume of the pressurized liquid stream fed to the process.

13. A process in accordance with claim 1, 2, 3, 4, 5, 6, 7, 8 or 9 wherein the pressurized liquid stream is a liquefied, lean natural gas.

14. A process in accordance with claim 13 wherein the first vapor phase component is a nitrogen-enriched vapor phase.

15. A process in accordance with claim 1 wherein a pressurized normally gaseous feed stream is cooled to its liquefaction temperature by passing said normally gaseous feed stream through at least one cooling stage in indirect heat exchange with at least one refrigerant to produce the pressurized liquid stream.

16. A process in accordance with claim 15 wherein the normally gaseous stream is passed through a plurality of cooling stages in indirect heat exchange with at least one refrigerant maintained at successively lower temperatures from the first to the last of said plural cooling stages.

17. A process in accordance with claim 16 wherein the plural cooling stages comprise two cooling cycles having a plurality of cooling stages in each cycle and a different refrigerant in each cycle.

18. A process in accordance with claim 17 wherein each cooling cycle comprises three stages of cooling.

19. A process in accordance with claim 18 wherein the upstream one of the cooling cycle utilizes a refrigerant having a higher boiling point than the refrigerant utilized in the downstream one of said cooling cycles.

20. A process in accordance with claim 19 wherein a portion of the higher boiling point refrigerant is utilized to cool the lower boiling point refrigerant.

21. A process in accordance with claim 20 wherein the higher boiling point refrigerant is propane and the lower boiling point refrigerant is ethylene.

22. A process in accordance with claim 15, 16, 17, 18, 19, 20 or 21 wherein the normally gaseous stream is a lean natural gas.

23. A process in accordance with claim 22 wherein the normally gaseous feed stream is at a pressure of about 650 psia.

24. A process in accordance with claim 22 wherein the first vapor phase component is a nitrogen-enriched vapor phase.

25. A process in accordance with claim 15, 16, 17, 18, 19, 20 or 21 wherein the relative volumes of the first portion of the pressurized liquid stream passed in indirect heat exchange with the fluid from the second pressure reduction step and the remainder of the pressurized liquid stream passed directly to the first pressure step are adjusted in accordance with changes in the total volume of the pressurized normally gaseous feed stream fed to the process.

26. A process in accordance with claim 25 wherein the relative volumes of the first portion of the pressurized liquid stream passed in indirect heat exchange with the fluid from the second pressure reduction step and the remainder of the pressurized liquid stream passed directly to the first pressure reduction step are adjusted to produce a volume of the first vapor phase component directly proportional to the volume of the pressurized normally gaseous feed stream fed to the process.

27. Apparatus for reducing the pressure and vaporizing at least a portion of a pressurized liquid stream, comprising:

a first pressure reduction means adapted to reduce the pressure of said pressurized liquid stream to a first reduced pressure and separate said pressurized liquid stream of reduced pressure into a first vapor phase component and a first liquid phase component;

a second pressure reduction means adapted to reduce the pressure of said first liquid phase component to a second reduced pressure lower than said first reduced pressure;

first liquid phase component conduit means adapted to pass said first liquid phase component from said first pressure reduction means to said second pressure reduction means;

bypass conduit means adapted to pass a first portion of said pressurized liquid stream directly to said first pressure reduction means;

pressurized liquid conduit means adapted to pass the remainder of said pressurized liquid stream through said second pressure reduction means in indirect heat exchange with fluid therein and thence to said first pressure reduction means; and control means operatively connected to one of said bypass conduit means, said pressurized liquid conduit means or both and adapted to vary the relative volumes of said first portion of said pressurized liquid stream passed through said bypass conduit means and said pressurized liquid stream passed through said pressurized liquid conduit means.

28. Apparatus in accordance with claim 27 wherein the control means is operatively connected to the bypass conduit means and is adapted to vary said volume of the first portion of the pressurized liquid stream passed through the bypass conduit means relative to the volume of the remainder of the pressurized liquid stream passed through the pressurized liquid conduit means.

29. Apparatus in accordance with claim 27 wherein the first pressure reduction means includes expansion valve means adapted to expand the pressurized liquid stream and a first flash vessel adapted to separate the expanded pressurized liquid stream into the first vapor phase component and the first liquid phase component.

30. A process in accordance with claim 29 wherein the second pressure reduction means includes a second flash vessel adapted to separate the expanded first liquid phase component into a second vapor phase component and a second liquid phase component.

31. Apparatus in accordance with claim 30 wherein at least one additional pressure reduction means is operatively connected to the second pressure reduction means and is adapted to reduce the pressure of the second liquid phase component.

32. Apparatus in accordance with claim 31 wherein the additional pressure reduction means includes two stages of pressure reduction wherein the first of said additional pressure reduction means is adapted to receive the second liquid phase component and expand and separate the same into a third vapor phase component and a third liquid phase component and the second additional pressure reduction means is adapted to receive the third liquid phase component and expand and separate the same into a fourth vapor phase component and a fourth liquid phase component.

33. Apparatus in accordance with claim 32 wherein each of the additional pressure reduction stages includes expansion valve means adapted to expand the liquid phase component fed thereto and a flash vessel adapted to separate the expanded liquid phase component into a vapor phase component and a liquid phase component.

34. Apparatus in accordance with claim 27, 28, 29, 30, 31, 32 or 33 wherein the control means includes means for measuring the total volume of pressurized liquid fed to the system and means for controlling the relative volumes of the first portion of the pressurized liquid stream passed through the bypass conduit means and the remainder of the pressurized liquid stream passed through the pressurized liquid conduit means in accordance with changes in said measured volume of said pressurized liquid stream.

35. Apparatus in accordance with claim 34 wherein the control means further includes means for measuring the volume of the first vapor phase component and means for adjusting the relative volumes of the first portion of the pressurized liquid stream passed through the bypass conduit means and the volume of the remainder of the pressurized liquid stream passed through the pressurized liquid conduit means to produce a volume of said first vapor phase component in direct proportion to the measured volume of said pressurized liquid stream.

36. Apparatus in accordance with claim 27, 28, 29, 30, 31, 32 or 33 wherein the apparatus is adapted to process a liquefied natural gas.

37. Apparatus in accordance with claim 36 wherein the first pressure reduction means is adapted to separate a nitrogen-enriched vapor phase as the first vapor phase component.

38. Apparatus in accordance with claim 27, 28, 29, 30, 31, 32 or 33 wherein the apparatus includes cooling means comprising at least one stage of cooling and adapted to cool a pressurized normally gaseous feed stream to its liquefaction temperature by indirect heat exchange with at least one refrigerant to produce the pressurized liquid stream operatively connected to the bypass conduit means and the pressurized liquid conduit means and recycle vapor phase conduit means adapted to recycle the second vapor phase component and any subsequent vapor phase components to the normally gaseous feed stream and combine said vapor phase components therewith prior to the liquefaction of said normally gaseous feed stream.

39. Apparatus in accordance with claim 27 wherein the apparatus includes cooling means comprising at least one stage of cooling and adapted to cool a pressurized normally gaseous feed stream to its liquefaction temperature by indirect heat exchange with at least one refrigerant to produce the pressurized liquid stream operatively connected to the bypass conduit means and the pressurized liquid conduit means.

40. Apparatus in accordance with claim 39 wherein the cooling means includes a plurality of cooling stages adapted to cool the normally gaseous feed stream by indirect heat exchange with at least one refrigerant at successively lower temperatures from the first to the last of said plural cooling stages.

41. Apparatus in accordance with claim 40 wherein the plural cooling stages comprise two cooling cycles having a plurality of cooling stages in each cycle and adapted to utilize a different refrigerant in each cycle.

42. Apparatus in accordance with claim 41 wherein each cooling cycle comprises three stages of cooling.

43. Apparatus in accordance with claim 42 wherein the refrigerant utilized in the downstream one of the cooling cycles is adapted to be cooled by the refrigerant utilized in the upstream one of said cooling cycles.

44. Apparatus in accordance with claim 39, 40, 41, 42 or 43 wherein the apparatus is adapted to process a natural gas feed stream.

45. Apparatus in accordance with claim 44 wherein the first pressure reduction means is adapted to separate a nitrogen-enriched vapor phase as the first vapor phase component.

46. Apparatus in accordance with claim 39, 40, 41, 42 or 43 wherein the control means includes means for measuring the total volume of pressurized normally gaseous feed stream to the process and means for controlling the relative volume of the first portion of the pressurized liquid stream passed through the bypass conduit means and the volume of the remainder of the pressurized liquid stream passed through the pressurized liquid conduit means in accordance with changes in said measured volume of the pressurized normally gaseous stream.

47. Apparatus in accordance with claim 46 wherein the apparatus includes means for measuring the volume of the first vapor phase component produced in the first pressure reduction means and controlling the relative volumes of the first portion of the pressurized liquid stream passed through the bypass conduit means and the volume of the remainder of the pressurized liquid stream passed through the pressurized liquid conduit means to maintain said volume of said first vapor phase component produced by said first pressure reduction means in direct proportion to the measured volume of said pressurized normally gaseous feed stream to the system.

* * * * *

UNITED STATES PATENT AND TRADEMARK OFFICE

CERTIFICATE OF CORRECTION

PATENT NO. : 4,172,711

DATED : October 30, 1979

INVENTOR(S) : Dunn M. Bailey

It is certified that error appears in the above-identified patent and that said Letters Patent are hereby corrected as shown below:

Column 12, claim 19, line 38, after "cooling" and before "utilizes" change "cycle" to --- cycles ---.

Column 13, claim 27, line 36, after "said" and before "pressurized" insert --- remainder of said ---.

Signed and Sealed this

Tenth Day of March 1981

[SEAL]

Attest:

RENE D. TEGTMEYER

Attesting Officer

Acting Commissioner of Patents and Trademarks